United States Patent [19]

Benoit et al.

[11] 4,311,975

[45] Jan. 19, 1982

[54] FREQUENCY BAND FILTER

[75] Inventors: Michel Benoit; Pierre Gerlach; Claude Grolleau; Alain Lartillot, all of Paris, France

[73] Assignee: Thomson CSF, Paris, France

[21] Appl. No.: 104,913

[22] Filed: Dec. 18, 1979

[30] Foreign Application Priority Data

Dec. 22, 1978 [FR] France ..... 78 36248

[51] Int. Cl.[3] ..... H01P 1/205; H01P 7/04

[52] U.S. Cl. ..... 333/207; 333/226; 333/235

[58] Field of Search ..... 333/206, 207, 202, 222–226, 333/245, 235, 263; 334/41–45

[56] References Cited

U.S. PATENT DOCUMENTS

| | | | |
|---|---|---|---|
| 2,410,656 | 11/1946 | Herold | 333/207 X |
| 2,438,913 | 4/1948 | Hansen | 333/206 |
| 3,144,624 | 8/1964 | Rypinski, Jr. | 333/206 |
| 4,223,287 | 9/1980 | Nishikawa et al. | 333/207 X |

*Primary Examiner*—Marvin L. Nussbaum
*Attorney, Agent, or Firm*—Roland Plottel

[57] ABSTRACT

A frequency band filter includes a plurality of coupled elementary resonator cavities defined by pistons disposed within a coaxial line. The position of the pistons along the line is adjustable thereby providing selectable tuning.

7 Claims, 4 Drawing Figures

FREQUENCY BAND FILTER

BACKGROUND OF THE INVENTION

The present invention relates to a frequency band filter.

It is pointed out that a frequency band filter selects a given frequency band and can be used as a band pass filter or as a band stop filter, depending on whether it is mounted in series or in parallel with respect to the device supplying the signal to be processed. It is known to obtain frequency band filters by using a plurality of resonator cavities coupled to one another. Each cavity generally comprises a coaxial line terminated by a short circuit, determining a voltage node of the standing wave system established in the line. The different cavities of a frequency band filter, which are constructed separately, can be arranged in the vicinity of one another and coupled together, for example by plate capacitors. It is also known to obtain band filters by using cavities, whereof the outer conductor of the coaxial line serves as the inner conductor for the coaxial line of another cavity.

The prior art frequency band filters have numerous disadvantages and reference is made to certain of these below:

The large number of assemblies, by pressure or by welding, involved in the manufacture thereof, so that manufacturing costs are high.

Their complicated construction which, in the case of high power filters, makes it difficult for the air intended for cooling the conductors to circulate and consequently to prevent ionization of the air in certain regions.

The fact that the inter-cavity coupling means, which must be arranged as close as possible to the potential loops have to withstand generally high voltages, making their design difficult. These means also have series reactances, which are often prejudicial to performance characteristics.

BRIEF SUMMARY OF THE INVENTION

The present invention relates to a frequency band filter having a single coaxial line, separated into a plurality of elementary resonator cavities by pistons, which determine the voltage nodes of the standing wave system established in the line, coupling being provided between two successive resonator cavities. According to a preferred embodiment of the invention the pistons which partition the cavities also ensure the coupling between the two successive cavities. The capacitive or inductive coupling obtained can be regulatable. According to a preferred embodiment of the invention the position of the pistons on the line can be regulated. The pistons also ensure the frequency tuning of the elementary cavities.

The frequency band filters according to the invention have the following advantages:

They are simple and inexpensive to manufacture, because they only have a single coaxial line.

As the different cavities are aligned the circulation of air for cooling the conductors and preventing the ionization of the air in certain regions of the filter is easily obtained. All the air flow injected into the filter is received by the pistons, which are able to partition the cavities, couple the same and tune the frequency thereof.

As the pistons are arranged at the voltage nodes, they do not have to satisfy any requirement with regard to the dielectric strength. However, they are obviously located at the current loops, but this does not cause any problem because, for other reasons, they are dimensioned for much higher currents than those imposed on them. The pistons of the band filters according to the invention, when they provide both the partitioning and coupling of the cavities, make it possible to overcome almost all the series reactances attached to the coupling means of the band filters according to the prior art.

The frequency band filters according to the invention can be used in UHF and VHF power amplifiers intended for television transmitters and certain radar systems, equipped with grid tubes. In this case there are generally two or three cavities. The frequency band filters according to the invention can also be used for filtering broad band, high frequency energy supplied by semiconductor arrangements.

BRIEF DESCRIPTION OF THE DRAWINGS

The invention is described in greater detail hereinafter relative to non-limitative embodiments and with reference to the attached drawings, wherein show.

DETAILED DESCRIPTION OF THE PREFERRED EMBODIMENTS

Figure 1:
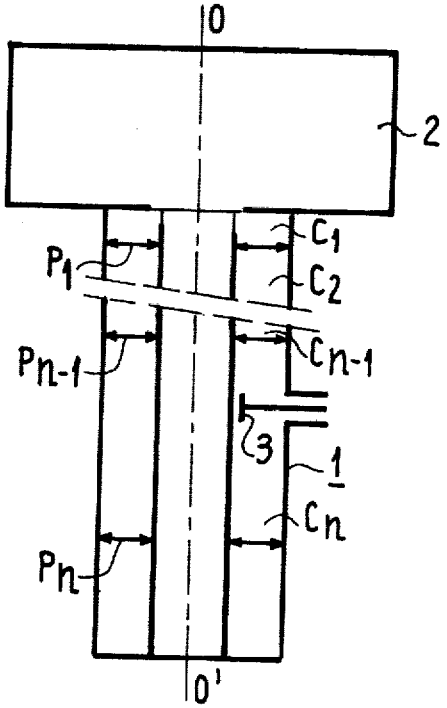
FIG. 1 an embodiment of a frequency band filter according to the invention.

FIG. 1 shows an embodiment of a frequency band filter according to the invention. The frequency band filter according to the invention has a single, generally cylindrical coaxial line and in FIG. 1 it is shown in longitudinal section along the axis 00' of the line. This coaxial line 1 is subdivided into a plurality of elementary resonator cavities $C_1$, $C_2 \ldots C_{n-1}$, $C_n$ by pistons $P_1 \ldots P_{n-1}$, $P_n$, shown symbolically in the drawing. The pistons are positioned at the voltage nodes of the standing wave system established in the line by a device 2, to which the line is coupled and which can for example be a grid tube or a semiconductor arrangement.

FIG. 1 shows the plate capacitor 3 permitting the sampling of energy from the filter. The coupling means between two successive resonator cavities are not shown in FIG. 1. They can be constituted in per se known manner by a plate capacitor positioned at a potential loop in each elementary cavity, which transmits the energy sampled on this cavity to the following cavity, whereby the two successive cavities can be connected via the interior or the exterior of the filter. The pistons which partition the cavities can also couple the same. Coupling can be either capacitive or inductive. In the case of capacitive coupling the pistons are in electrical contact with one of the walls of the coaxial line and are insulated from the other wall. Coupling by so-called "common capacitance" is established between the cavities in place of the conventionally used coupling "by head capacitances".

Figure 2:
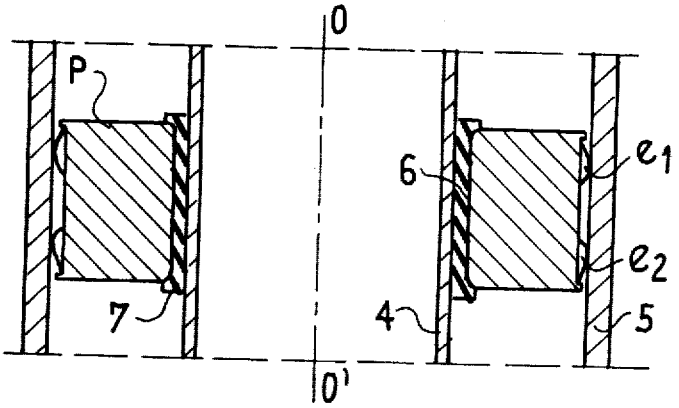
FIG. 2 an embodiment in accordance with the invention of a piston ensuring capacitive coupling between cavities.

FIG. 2 shows an embodiment according to the invention of a piston providing capacitive coupling between the cavities. Piston P, shown in FIG. 2 in longitudinal section parallel to axis 00' of the line is in exemplified manner in electrical contact with the outer wall 5 of the line. Electrical contact can be obtained in per se known manner by elastic contacts $e_1$, $e_2$. The piston is generally made from materials which are good conductors, such as brass or bronze covered with silver or gold. Piston P is insulated from the inner wall 4 of the coaxial line by an insulator.

This insulator may only be an air gap. In this case the circulation of air for cooling the conductors and preventing the ionization of the air in certain regions of the filter takes place by means of the space existing between each piston and one of the walls of the coaxial line. The disadvantages of this type of insulator is the low permittivity of air (equal to one) and therefore the low value of the coupling capacitance between the cavities obtained in this way.

As shown in FIG. 2 the insulator can also be a cylinder 7 made from insulating material, whose mechanical properties are adapted to the friction and which has a high permittivity, such as polytetrafluoroethylene (permittivity equal to two). It is also possible to use a material, such as a ceramic material, whose permittivity is very high and specifically approximately nine. However, in this case due to the brittleness of the ceramic material and its high abrasive properties the inner and outer walls of the ceramic cylinder must be metalized and the electrical contacts must be positioned on either side of said walls. In the embodiments where the insulator is not air, the circulation of air in the filter takes place by means of orifices made in the pistons and whose dimensions are sufficiently small so as not to disturb the electrical operation of the filter.

The capacitive coupling between cavities is regulatable by modifying the distance between the wall of the coaxial line insulated from the piston (wall 4 in FIG. 2) and the facing piston wall (wall 6 in FIG. 2). The coaxial line wall which is insulated from the piston can for example have a bulge and the capacitive coupling value between cavities thus depends on the position of the piston on the line. In this case, besides regulating the capacitive coupling between the cavities the frequency tuning of the cavities is regulated by modifying the position of the piston on the line.

Figure 3:
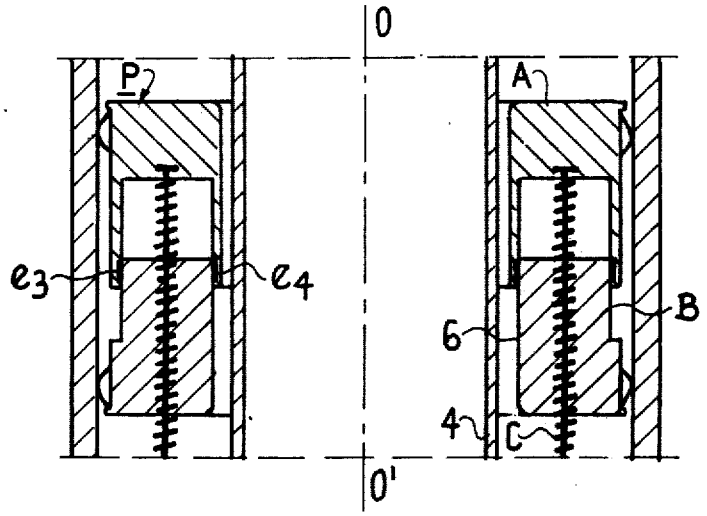
FIG. 3 an embodiment according to the invention of a piston ensuring a regulatable capacitive coupling between cavities.

Capacitive coupling between cavities is also regulatable by modifying the length of the piston wall facing the coaxial line wall insulated from the piston. In the embodiment shown in FIG. 3 piston P, viewed in longitudinal section parallel to axis 00' of the line, is constituted by two parts A and B which are fitted into one another and whose spacing can vary by means of a translation control device C, represented symbolically in FIG. 3, said devices forming part of the prior art. The length of the wall of piston 6 facing the wall of the coaxial line insulated from the piston varies with the spacing of parts A and B of the piston, so that the capacitive coupling obtained is therefore regulatable. If the length, along axis 00', of the piston formed by the two parts A and B is considerable elastic contacts $e_3$ and $e_4$ are provided for electrically connecting parts A and B, as shown in FIG. 3. If the piston length is small parts A and B can be insulated.

Figure 4:
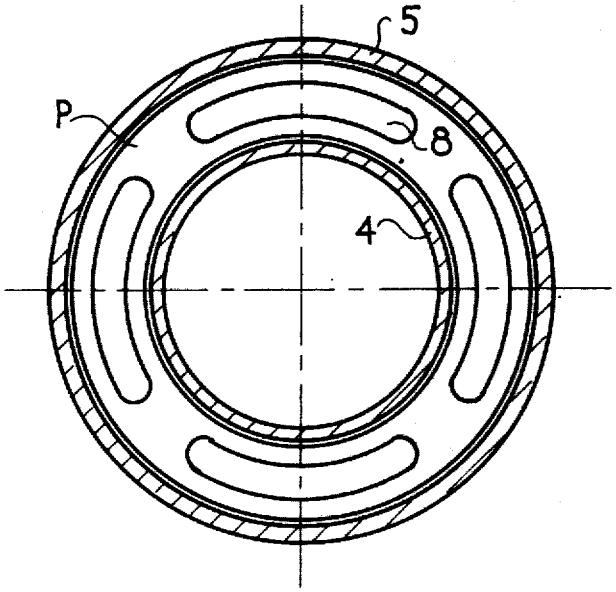
FIG. 4 an embodiment according to the invention of a piston ensuring inductive coupling between cavities.

The pistons which partition the cavities can also ensure an inductive coupling between cavities, FIG. 4 is a plan view of an embodiment of a piston P, which ensures an inductive coupling between the cavities. Piston P is in electrical contact with walls 4 and 5 of the coaxial line and has orifices 8 linking two successive cavities. There is a so-called "common choke" coupling between the cavities. The number and shape of the orifices 8 are established as a function of the desired coupling.

The inductive coupling between the cavities is regulatable by modifying the dimensions of the orifices made in the pistons. Each piston can comprise two discs perforated by orifices, like the disc shown in FIG. 4. A mechanical device, such as that known from the prior art, brings about the rotation of one of the discs or its translation about the axis 00' of the line, so that the dimensions of the orifices linking two successive cavities are modified. If each of the two discs has elastic contacts electrically connecting it to the walls of the coaxial line it is not absolutely necessary to provide elastic contacts in the region of their engagement and said contacts can be replaced by an insulant having good friction properties, such as polytetrafluoroethylene. When only one of the discs has elastic contacts, the latter are located at the junction between the two discs.

Thus, in addition to the partitioning and coupling of the cavities, the pistons can effect the frequency tuning thereof. For this purpose the position of the pistons on the line is changed.

The position of the pistons on the line can be regulated in known manner and not shown in the drawings from the exterior of the band filter. Each piston can have rods, generally three rods, made from insulating material and arranged parallel to axis 00' of the line and which leads to the outside of the band filter. With respect to each piston it is also possible to provide slots, generally three slots, made in the outer wall of the line and parallel to axis 00' of said line. Pins slid into these slots make it possible to modify the position of the pistons on the line. In the same way the regulation of the capacitive and inductive couplings established between the capacitances is carred out in per se known manner from the exterior of the band filter.

The invention is not limited to the embodiments described and represented hereinbefore and various modifications can be made thereto without passing beyond the scope of the invention.

What is claimed is:

1. A band pass filter, wherein it has a single coaxial line, separated into a plurality of elementary resonator cavities by pistons, which determine the voltage nodes of the standing wave system established in the line, said pistons ensuring the coupling between two successive resonator cavities and the frequency tuning of the elementary cavities, their position on the line being regulatable.

2. A filter according to claim 1, wherein between two successive resonator cavities the pistons ensure a coupling, which is regulatable.

3. A filter according to claim 1 or to claim 2, wherein the pistons are in electrical contact with one of the walls of the coaxial line and are insulated from the other wall, a capacitive coupling being established between two successive resonator cavities.

4. A filter according to claim 1 or to claim 2, wherein the pistons which are in electrical contact with the two walls of the coaxial line have orifices, which link two successive cavities, an inductive coupling being thus established between two successive resonator cavities.

5. A filter according to claim 3, wherein the capacitive coupling is regulatable by modifying the distance between the coaxial line wall insulated from the piston and the facing piston wall.

6. A filter according to claim 3, wherein the capacitive coupling is regulatable by modifying the length of the piston wall facing the coaxial line wall which is insulated from the piston.

7. A filter according to claim 4, wherein the inductive coupling is regulatable by modifying the dimensions of the orifices made in the pistons.

* * * * *